United States Patent [19]

Palmer et al.

[11] Patent Number: 4,862,190

[45] Date of Patent: Aug. 29, 1989

[54] DEPLOYABLE OFFSET DISH STRUCTURE

[75] Inventors: William B. Palmer, Rancho Palos Verdes; Martin M. Giebler, Redondo Beach, both of Calif.

[73] Assignee: TRW Inc., Redondo Beach, Calif.

[21] Appl. No.: 49,919

[22] Filed: May 15, 1987

[51] Int. Cl.[4] ..... H01Q 15/20

[52] U.S. Cl. ..... 343/915

[58] Field of Search ..... 343/915, 834, 912

[56] References Cited

U.S. PATENT DOCUMENTS

| | | | |
|---|---|---|---|
| 2,572,430 | 10/1951 | Balton | 250/33.65 |
| 2,806,134 | 9/1957 | Tarcici | 240/103 |
| 2,985,881 | 5/1961 | Holland et al. | 343/912 |
| 3,064,534 | 11/1962 | Tumavicus | 88/84 |
| 3,176,303 | 3/1965 | Holland | 343/915 |
| 3,286,270 | 11/1966 | Kelly | 343/915 |
| 3,360,798 | 12/1967 | Mason et al. | 343/915 |
| 3,397,399 | 8/1968 | Carman et al. | 343/915 |
| 3,521,290 | 7/1970 | Bahiman et al. | 343/915 |
| 3,541,569 | 11/1970 | Berks et al. | 343/915 |
| 3,576,566 | 4/1971 | Cover et al. | 343/705 |
| 3,617,113 | 11/1971 | Hoyer | 350/299 |
| 3,635,547 | 1/1972 | Rushing et al. | 350/288 |
| 3,699,576 | 10/1972 | Hoyer | 343/18 B |
| 3,707,720 | 12/1972 | Staehlin et al. | 343/755 |
| 3,715,760 | 2/1973 | Palmer | 343/915 |
| 3,717,879 | 2/1973 | Ganssle | 343/915 |
| 4,030,102 | 6/1977 | Kaplan et al. | 343/915 |
| 4,030,103 | 6/1977 | Campbell | 343/915 |
| 4,314,253 | 2/1982 | Sayovitz | 343/765 |
| 4,315,265 | 2/1982 | Palmer et al. | 343/840 |
| 4,352,113 | 9/1982 | Labruyere | 343/915 |
| 4,482,900 | 11/1984 | Bilek et al. | 343/915 |
| 4,498,087 | 2/1985 | Imbiel et al. | 343/915 |
| 4,646,102 | 2/1987 | Akaeda et al. | 343/915 |

*Primary Examiner*—William L. Sikes
*Assistant Examiner*—Robert E. Wise
*Attorney, Agent, or Firm*—Noel F. Heal

[57] ABSTRACT

An offset collapsible/deployable dish having solid, relatively rigid folding panels which are unfoldable to a dish configuration conforming to an offset surface of revolution, such as an offset paraboloid generated about an axis offset from the dish, and foldable to a collapsed configuration contained within an envelope substantially smaller than the rim diameter of the dish. A radiation device utilizing the offset dish as a microwave, optical, or high energy beam reflector.

4 Claims, 4 Drawing Sheets

DEPLOYABLE OFFSET DISH STRUCTURE

BACKGROUND OF THE INVENTION

1. FIELD OF THE INVENTION

This invention relates generally to radiation reflectors, commonly called dishes, which are used in combination with a radiation transducer, such as a radiation emitter or detector, situated at a focus of the reflector to project or receive a radiation beam along a path parallel to the principal axis of the dish. The invention relates more particularly to a collapsible and deployable offset dish of this kind whose focus, and the radiation transducer used with the reflector, are situated outside the dish beam path.

2. PRIOR ART

Radiation reflectors or dishes of the type to which this invention pertains are utilized over a wide range of the electro-magnetic radiation spectrum and in a variety of reflector-type radiation transmitting and receiving devices. Such radiation transmitting and receiving devices are collectively referred to herein simply as radiation devices. Examples of such radiation devices are parabolic dish antennas, solar concentrator collectors, high energy beam devices and the like.

Radiation devices of the character described are commonly characterized by a radiation reflector dish and a radiation transducer situated in front of the dish. This transducer may be either or both a radiation emitter, which emits radiation toward the dish that is reflected outwardly along the principal axis of the device, and/or a radiation detector, which receives radiation incident on the dish from a remote source that is reflected to the transducer. In a parabolic dish antenna, for example, the transducer may be either or both a radiation emitter called a feed or a radiation detector. In a solar concentrator - collector, the transducer may be a solar energy converter, such as a solar cell. In a high energy beam device, the transducer may be a high energy radiation source. Other high energy beam devices may have a reflector only for collecting and focusing high energy beams in space.

The present invention will be disclosed primarily in connection with a parabolic dish antenna. It will become evident as the description proceeds, however, that the principles of the invention may be utilized in other radiation devices of the class described.

The construction, operation, and characteristics of a conventional parabolic dish antenna are well-known and understood. Accordingly, it is necessary to describe the conventional antenna only in sufficient detail to enable a full and complete understanding of the invention.

A conventional parabolic dish antenna has a parabolic or paraboloidal reflector dish whose reflecting surface conforms substantially to a parabolic surface of revolution, that is a paraboloidal surface, generated about an axis of the dish called its principal axis. The surface has a focus located on this axis. Situated at the focus is the antenna transducer, which may be either or both a radiation emitter or feed and/or detector. In the antenna art, this transducer is commonly referred to as the primary aperture of the antenna. The antenna dish is referred to as the secondary aperture of the antenna.

In a transmitting parabolic dish antenna, radiation is emitted from its primary aperture or feed transducer toward its secondary aperture or dish and is reflected from the latter in the form of a beam parallel to the principal axis of the dish. In a receiving antenna, a beam of incoming radiation incident on the secondary aperture or dish parallel to its principal axis is reflected to the primary aperture or detection transducer. In the following description, the paths of these outgoing and incoming beams are referred to as the beam paths of the secondary aperture or dish.

Two different types of parabolic dish antennas, referred to herein as symmetrical and offset antennas, have been devised. The secondary aperture of a symmetrical parabolic dish antenna is normally a circular dish that is symmetrical about its principal axis so that this axis passes through the center of the dish. The primary aperture of the symmetrical antenna is situated in front of the secondary aperture and is, therefore, located in the secondary aperture beam path.

A transmitting symmetrical parabolic dish antenna has two disadvantages: (1) the beam reflected from the secondary aperture or dish impinges the antenna feed and alters its input impedance; (2) the antenna feed and its support obstructs and distorts the reflected beam. In a receiving symmetrical parabolic dish antenna, its detector is situated in the incoming beam path and, hence, alters and distorts the incoming beam.

An offset parabolic dish antenna eliminates these disadvantages. To this end, the secondary aperture of such an antenna comprises a paraboloidal dish which is only an offset portion of the symmetrical antenna dish, that is, a portion of the symmetrical dish offset from the principal axis of the dish. In such an offset antenna, therefore, the principal axis and focus, and hence also the primary aperture, are offset to one side of the secondary aperture so that the primary aperture is located outside the secondary aperture beam path.

Many applications of parabolic dish antennas permit the use of fixed dishes which are permanently fixed in their paraboloidal operating configuration. Other applications of such antennas, notably space applications, require the capability of collapsing the antenna to a compact configuration for storage and deploying the antenna to its paraboloidal operating configuration. The present invention is particularly concerned with such collapsible and deployable parabolic dish antennas.

The prior art is replete with a variety of collapsible/deployable parabolic or paraboloidal antenna dishes. Examples of collapsible/deployable symmetrical paraboloidal antenna dishes are described in the following patents:

| | |
|---|---|
| 2,572,430 | 3,617,113 |
| 2,806,134 | 3,635,547 |
| 3,064,534 | 3,699,756 |
| 3,176,303 | 3,707,720 |
| 3,286,270 | 3,715,760 |
| 3,360,798 | 3,717,879 |
| 3,397,399 | 4,030,102 |
| 3,521,290 | 4,314,253 |
| 3,541,569 | 4,315,265 |
| 3,576,566 | 4,352,113 |

U.S. Pat. Nos. 4,030,103 and 4,498,087 disclose parabolic dish antennas with a collapsible/deployable off-center paraboloidal antenna dish.

Some of the collapsible/deployable paraboloidal antenna dishes disclosed in the above patents utilize reflecting surfaces of wire mesh or the like. These antennas have functioned quite satisfactorily up to the present time because of their compatibility with the wavelengths that have been used in the past and will continue to function satisfactorily for those applications that involve such wavelengths.

There is, however, an ever increasing use of shorter and shorter wavelengths of the electromagnetic spectrum, as well as an increasing interest in collecting and focusing light waves and other short wavelength energy in space. Reflector dishes for these shorter wavelengths and light waves must satisfy stringent requirements of smoothness and contour in order to minimize scattering and enhance gain. These requirements have resulted in increasing usage of reflectors whose reflecting surfaces are solid, as contrasted to wire mesh for example, and rigid, as contrasted to a metal coated plastic membrane.

Many of the patents listed above disclose collapsible/deployable parabolic dishes which provide such a relatively solid and rigid paraboloidal reflecting surface when deployed. These dishes commonly comprise relatively rigid solid panels which are foldable and unfoldable between contracted and extended positions. When the panels are contracted, the dish is collapsed to a compact storage configuration. When the panels are extended, the dish is expanded to its deployed configuration, wherein the dish provides a relatively solid and rigid paraboloidal reflecting surface. These solid rigid collapsible and deployable dishes, however, are all symmetrical dishes which suffer from the disadvantages discussed earlier.

The only listed patents disclosing parabolic dishes which are offset parabolic dishes and, hence, are not subject to such disadvantages are U.S. Pat. Nos. 4,030,103 and 4,498,087. These offset parabolic dishes, however, have a wire mesh reflecting surface and, therefore, are not suitable for the shorter and shorter wavelengths and light waves which are now in use or contemplated for future use. Accordingly, there is a need for a solid rigid offset parabolic dish.

SUMMARY OF THE INVENTION

The present invention satisfies this need and provides a collapsible and deployable off-set parabolic dish structure having a relatively solid and rigid paraboloidal reflecting surface when deployed. The invention also provides radiation devices embodying the improved dish structure.

The improved dish structure of the invention has a plurality of solid relatively rigid outer panels arranged circumferentially about a solid rigid center panel and pivotally joined to one another and to the center panel for folding and unfolding of the outer panels between contracted and extended positions. When the outer panels are unfolded to their extended positions, the dish structure assumes a deployed configuration. The several panels then define a relatively solid and rigid dish of given rim diameter whose front surface conforms substantially to an offset paraboloidal surface. The principal axis and focus of this surface are offset to one side of the dish so that the axis does not intersect the surface. When the outer panels are folded to their contracted positions, the dish structure assumes a collapsed configuration. In this configuration, the dish structure is contained within an envelope of substantially smaller diameter than the rim diameter of the deployed dish structure.

A presently preferred embodiment of the invention is a parabolic dish antenna whose dish structure is similar in some respects to the dish structures disclosed in the earlier mentioned U.S. Pat. Nos. 3,715,760 and 4,315,265. The outer panels of this preferred embodiment comprise a plurality of panel assemblies each including a generally radial center panel between two generally radial side panels. The inner ends of the center panels are pivotally joined by hinges to the center panel on pivot axes tangent to a common circle having its center at the center of the center panel. The center and side panels of each panel assembly are pivotally joined by hinges along their longitudinal, generally radial edges. Finally, the adjacent panel assemblies are pivotally joined by hinges along their longitudinal, generally radial edges.

The arrangement of the panel hinges is such that during extension and retraction of the outer dish panels, the center panels of the panel assemblies rotate in and out about their inner end hinges. The side panels fold and unfold in a generally accordion fashion about their longitudinal edge hinges. The inner ends of the center panels are operatively coupled for extension and retraction in unison by a motor.

The dish structure of the invention has a single plane of symmetry containing the principal axis of the dish paraboloid and the center of the center panel of the dish. When deployed, the dish conforms substantially to an offset paraboloidal surface.

In addition to the collapsible/deployable dish structure of the invention, the parabolic dish antenna of the preferred embodiment has a transducer, i.e. a feed and/or detector, mounted on a support which folds and unfolds with the dish panels between contracted and extended positions. The transducer constitutes the primary aperture of the antenna and the dish constitutes its secondary aperture. When the antenna is fully deployed, the primary aperture is offset to one side of the secondary aperture and, hence, is situated outside the secondary aperture beam path. The antenna thus avoids the disadvantages, mentioned earlier, of a parabolic dish antenna with a symmetrical dish.

It should be noted at the outset that while the presently preferred embodiments of the invention are paraboloidal dishes, the principles of the invention may be utilized in offset dish structures which conform to other surfaces of revolution.

DESCRIPTION OF THE PREFERRED EMBODIMENTS

Figures 1, 2:
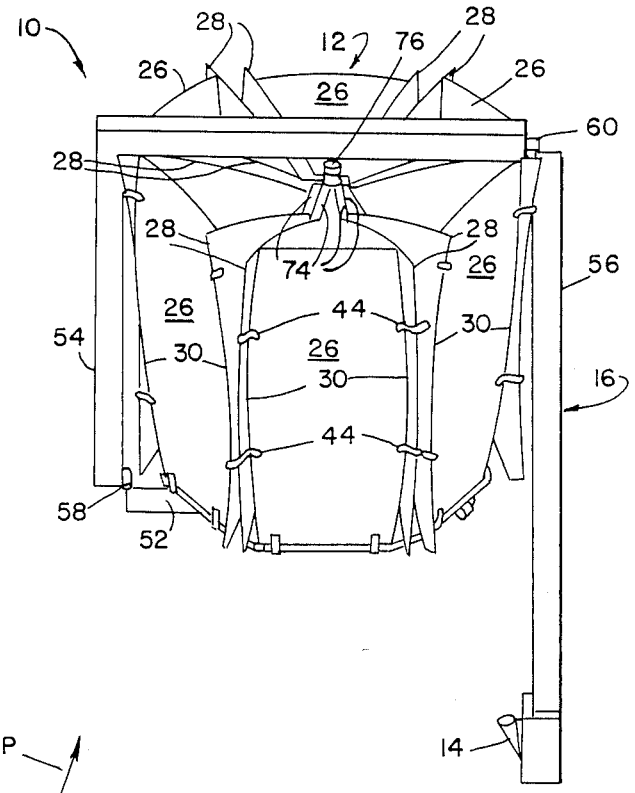
FIG. 1 is a perspective view of a dish structure according to the invention in its collapsed configuration.
FIG. 2 is a perspective view of the dish structure in its deployed configuration.
Figure 4:
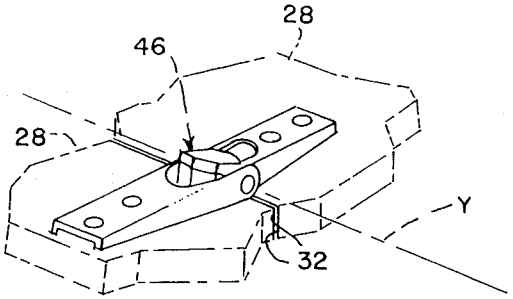
FIGS. 3 and 4 are enlarged perspective views of hinges embodied in the dish structure.
Figure 3:
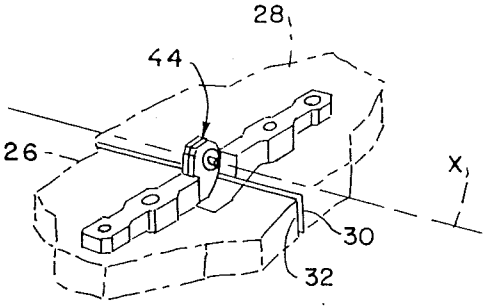
Figure 5:
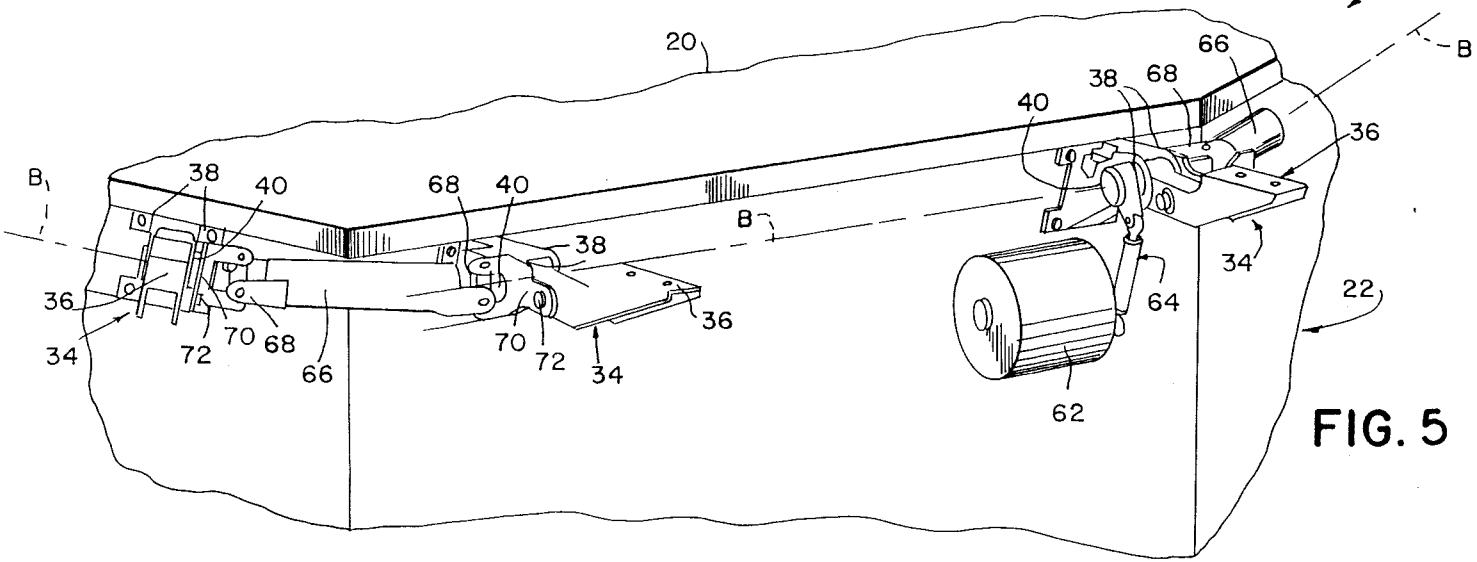
FIG. 5 is an enlarged fragmentary perspective view of a central panel and support of the dish structure.
Figure 6:
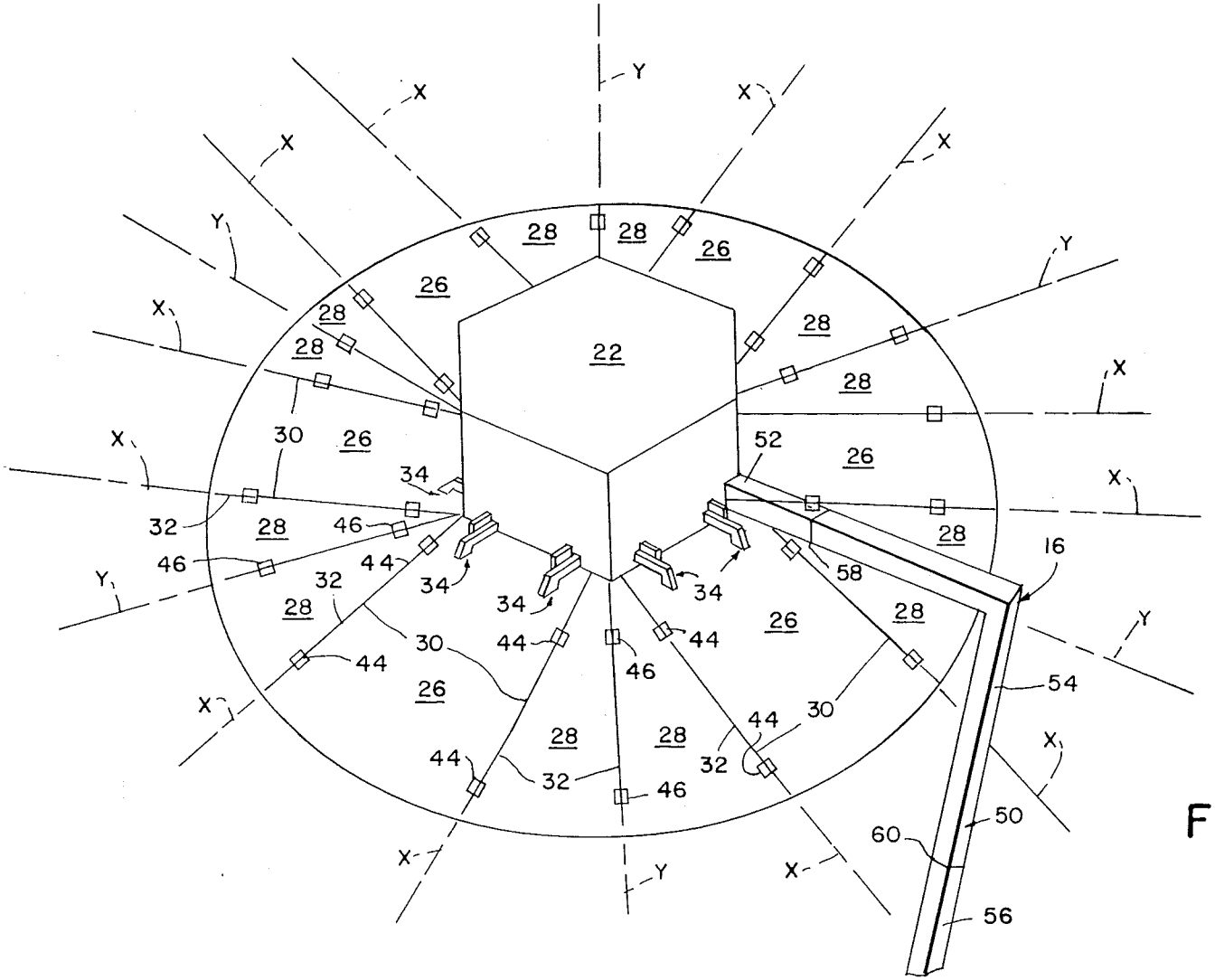
FIG. 6 is a perspective view of the back side of the deployed dish structure.

The drawings illustrate a on radiation device 10 including an offset, collapsible and deployable dish structure or dish 12 according to the invention. In addition to the dish 12, the radiation device 10 includes a radiation transducer 14 mounted on a support 16 which is collapsible and deployable with the dish. When deployed, the dish 12 has a principal axis A and a focus F on this axis. The transducer 14, when deployed, is situated at the focus F.

The transducer 14 may be either or both a radiation emitter or source and a radiation detector or receiver. If a radiation emitter or source, the transducer 14 emits radiation toward the deployed dish 12, which then reflects the radiation parallel to the principal axis A in the form of a beam. The path of this beam is designated P. If the transducer 14 is a radiation detector or receiver, it receives incoming radiation that is incident on the deployed dish 12 along the beam path P and then reflected from the dish to the transducer.

Referring now in more detail to the drawings, the illustrated radiation device 10 is a parabolic dish antenna. The transducer 14 is a feed in the form of a horn which may be designed to operate as either or both a radiation emitter and detector. As noted earlier, the feed 14 is commonly referred to as the primary aperture of the antenna. The dish is commonly referred to as the secondary aperture of the antenna.

The front surface 18 of the deployed dish 12 conforms to an offset paraboloidal surface. This is a parabolic surface of revolution generated about, but laterally offset from, the principal axis A. The antenna horn or primary aperture 14 of the antenna 10 is thus offset to one side of the antenna secondary aperture or dish 12 and is located outside the secondary aperture beam path P. This offset antenna arrangement avoids the earlier discussed disadvantages of a symmetrical parabolic dish antenna.

Dish 12 has a central fixed panel 20 rigidly joined to a support 22 at the rear side of and concentric with the panel. Arranged circumferentially about the fixed panel 20 are a plurality of foldable outer panels collectively designated as 23. These foldable panels are hinged to one another and to the center fixed panel 20 for folding to their contracted positions of FIG. 1 and unfolding to their extended positions of FIG. 2. In the unfolded positions of the panels 23, they and the central panel 20 form a dish which conforms to an offset paraboloid, as explained in more detail presently. When the panels 23 are retracted, the dish structure 12 is contained within an envelope substantially smaller in diameter than the rim diameter of the dish.

In the particular dish structure illustrated, the foldable panels 23 are arranged in panel assemblies 24. Each panel assembly 24 includes a center panel 26 and two side panels 28 at opposite sides of the center panel. Each center panel 26 has an arcuate rectangular shape, radially inner and outer ends and longitudinal edges 30. Each side panel 28 is generally triangular in shape and has radially inner and outer ends and inwardly convergent longitudinal edges 32.

The inner end of each center panel is joined to the outer perimeter of the support 22 by a pair of hinges 34. Each hinge 34 comprises an arm 36 having inner and outer ends, a pair of bracket plates 38 straddling the inner end of the arm, and hinge pins 40 extending through and pivotally joining the arm and bracket plates. The outer ends of the hinge arms 36 form brackets which are joined to the rear or underside of the respective center panel 26 adjacent its inner end. The two hinges 34 for each center panel have a common pivot axis B extending laterally of the panel.

Each side panel 28 is pivotally joined to the center panel 26 of its respective panel assembly 24, along the longitudinal edges of these panels, by hinges 44 having a common pivot axis X extending approximately along the respective panel edges. Each side panel 28 is pivotally joined to the adjacent side panel of the adjacent panel assembly 24, along the longitudinal panel edges, by hinges 46 having a common pivot axis Y.

The hinges 34, 44, 46 pivotally join the foldable panels 26, 28 to one another and to the central fixed panel 20 for inward folding of the foldable panels to their contracted positions of FIG. 1 and outward unfolding of these panels to their extended positions of FIG. 2. As will be explained in more detail presently, the several panels 20, 26, 28 are shaped and arranged so that when the foldable panels are extended, the dish structure assumes a generally circular dish configuration having a geometric center O and a front concave reflecting surface 18. This surface conforms to a parabolic surface of revolution, that is a paraboloidal surface, generated about the principal axis A and having the focus F. When the foldable panels 26, 28 are retracted, the dish structure assumes a collapsed configuration which is contained within an envelope of substantially smaller diameter than the deployed dish.

As thus far described, the dish structure 12 illustrated is quite similar in many respects to those disclosed in the earlier mentioned U.S. Pat. Nos. 3,715,760 and 4,315,265. As noted earlier, a major difference between the dish structures of these patents and that of this invention resides in the fact that the patented dishes are symmetrical parabolic dishes. The dish of this invention is an offset parabolic or paraboloidal dish. This feature of the invention will now be discussed.

Figure 7:
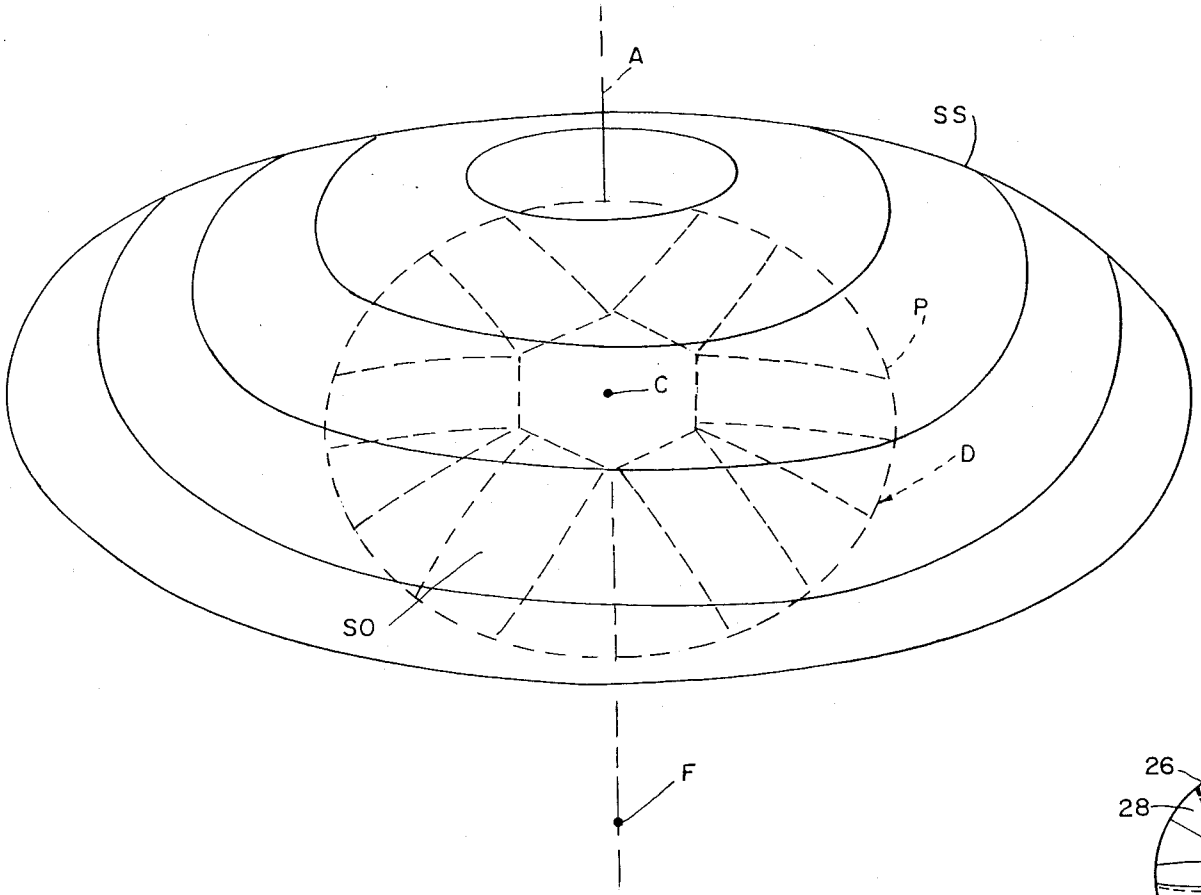
FIG. 7 is a perspective view of the back side of the deployed dish structure.

Referring to FIG. 7, reference character SS denotes a symmetrical parabolic surface of revolution, that is a symmetrical paraboloid, shown in solid lines, generated about an axis A, which is the principal axis of the paraboloid, and having a focus F on the axis. The axis A passes thru the geometric center of he surface SS so that the latter is symmetrical about the axis. As is well known to those versed in the antenna art and as discussed earlier, the primary aperture or horn of a parabolic dish antenna having such a symmetrical parabolic dish or secondary aperture is situated in the secondary aperture beam path P, resulting in the mentioned disadvantages.

The broken lines D in FIG. 7 represent the preferred offset parabolic dish 12 of the invention. The dish 12, and more specifically its front reflecting surface 18, conforms to the portion SO of the symmetrical paraboloidal surface SS bounded by the broken line P, which represents the perimeter of the dish. The surface portion SO is an offset paraboloidal surface which is laterally offset from and, hence, not intersected by the principal axis A of the symmetrical surface SS. The axis A, of course, is the principal axis of both the symmetrical surface SS and the offset surface SO and the two surfaces have the common focus F on the axis.

Figure 8:
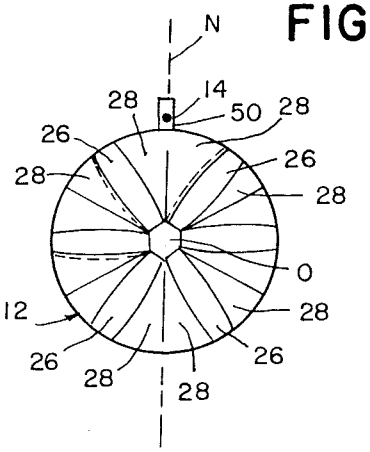
FIG. 8 is a front view on reduced scale of the dish structure.

The offset paraboloidal surface SO has a single plane of symetry containing the principal axis A and the geometric center C of the offset surface. Accordingly, dish 12 has a single plane N (FIG. 8) of symmetry containing the principal axis A and the center 0 of the dish. The number and arrangement of the panel assemblies 24 is such that the dish has two diametrically opposed hinge axes Y disposed in the plane N and an equal number of diametrically opposed panel assemblies at opposite sides of the plane. The particular dish shown has six panel assemblies, three at each side of the plane N of symmetry. The fixed central panel 20 is hexagonal in shape with a center foldable panel 26 hinged along each edge of the fixed panel about a hinge axis parallel to the adjacent fixed panel edge. When the panels 23 are extended, their front surfaces conform to the offset paraboloidal surface SO. The panel hinge axes Y are then disposed in diametrically opposed pairs with each pair located in a common plane containing the center O and two diametrically opposed corners of the fixed panel 20.

As noted earlier, the illustrated radiation device 10 is an offset parabolic dish antenna having a radiation transducer or feed 14 which constitutes the primary aperture of the antenna. The support 16 for this horn comprises an articulated support arm 50 including four sections 52, 54, 56 joined end to end by hinges 58, 60. The support arm section 52 is rigidly secured to the dish support 22 and extends generally radially out to a position wherein the outer end of the arm projects a short distance radially beyond an envelope containing the dish 12 in its collapsed configuration of FIG. 1. Support arm section 54 is an L-shaped arm having one end joined by the hinge 58 to the outer end of arm section 52 and an opposite right angle end joined by hinge 60 to one end of arm section 56. The antenna feed 14 is mounted on the other end of the arm section 56.

When the dish 12 is folded to its collapsed configuration of FIG. 1, the antenna feed support arm 50 is foldable to its contracted configuration shown. The dish and the support are unfoldable to their deployed configurations of FIG. 2. In the deployed configuration of the feed support arm 50, the antenna feed 14 is situated at the offset focus F of the offset paraboloidal dish 12. The feed support arm 50 is preferably located in and undergoes folding and unfolding movement in the plane N of symetry of the dish, and is preferably situated at the side of the dish adjacent the generation axis A.

The dish 12 and feed support arm 50 may be collapsed and deployed in various ways. In the particular embodiment illustrated, the several center panels 26 of the panel assemblies 24 are extendable and retractable in unison by a motor 62 mounted on the dish support 22 adjacent one center panel hinge 34. The shaft of this motor is coupled by linkage and crank means 64 to one end of the pivot shaft 40 of the adjacent center panel hinge 34. Extending between the opposite side of the latter hinge and the next adjacent center panel hinge 34, and between each succeeding pair of adjacent hinges 34 about the support 22, is a coupling shaft 66 joined at its ends to the adjacent hinge pivot shafts 40 by universal joints 68. That part of each universal joint which is secured to a hinge shaft has a radial arm 70 receiving a lug 72 on the adjacent hinge arm 36. Motor 62 is thus operable to rotate the center panels 26 of the dish panel assemblies 24 in unison between their extended and retracted positions. The panel hinges 44, 46 are spring loaded to resiliently bias the side panels 28 of the panel assemblies to their dish configuration of FIG. 2, when the center panels 26 are deployed outwardly by the motor 62 from their retracted positions of FIG. 1 to their extended positions of FIG. 2. These hinges embody stops for arresting unfolding of the panels.

Certain of the side panels 28 have tie-down arms 74 adjacent their edges 32 and projecting beyond the outer ends of the panels. When the panels are contracted to their collapsed configuration, the outer ends of these arms are joined by a pin-puller 76 which retains the panels firmly in their folded positions.

The hinges 58, 60 in the antenna feed support arm 50 are spring loaded to resiliently bias the support arm from its folded or collapsed configuration of FIG. 1 to its extended or deployed configuration of FIG. 2. Releasible lock means (not shown) retain the support in its folded configuration.

Deployment of the antenna 10 is accomplished by first releasing the feed support arm 50 for unfolding to its deployed position of FIG. 2 under the action of its spring loaded joints. The pin puller 76 is then released to release the dish panels 26, 28 for deployment after which these panels are deployed to their extended positions of FIG. 2 by operation of the motor 62.

During operation of the antenna in a transmitting mode, the antenna feed 14 emits radiation toward the dish 12, which then reflects the radiation outwardly along the beam path P. The feed 14 is laterally offset from this beam path and, hence, is not illuminated by the reflected radiation. Accordingly, the reflected radiation does not alter the input impedance of the feed, as occurs in a symmetrical parabolic dish antenna. Further, being out of the beam path, the feed does not obstruct the outgoing radiation beam. Similarly, when the antenna operates in a receiving mode, the feed is offset from and, hence, does not obstruct incoming radiation incident on the dish 12 that is along the beam path and then reflected to the feed.

It will be obvious at this point that the collapsible/deployable offset parabolic dish of the invention may be used for purposes other than a parabolic antenna reflector. For example, the dish can be an optical reflector for visible light or high energy radiation. For these uses, the transducer 14 of the radiation device 10 will be either or both a visible light source and/or detector or a high energy radiation source and/or detector, as the case may be.

We claim:

1. A collapsible/deployable offset dish structure, comprising:

a substantially rigid and solid fixed center panel; and a plurality of substantially rigid and solid outer panel assemblies foldably connected about the periphery of the fixed center panel;

wherein the outer panel assemblies are inwardly foldable to contracted positions in order to form a collapsed configuration for compact storage of the dish structure and the outer panel assemblies are outwardly foldable to extended positions in order to form a deployed configuration of the dish structure for operation as a reflecting surface, the deployed configuration of the dish structure conforming to an offset surface of revolution in which the principal axis of the offset surface of revolution does not intersect the surface of revolution.

2. The offset dish structure as set forth in claim 1, wherein the deployed configuration of the dish structure conforms to an offset parabolic surface of revolution having a single plane of symmetry, the single plane of symmetry including the principal axis of the parabolic surface of revolution and the center of the fixed center panel.

3. The offset dish structure as set forth in claim 1, wherein each of the outer panel assemblies includes a substantially rigid and solid movable center panel disposed between two substantially rigid and solid movable side panels, the movable center panel being pivotally joined to the fixed center panel and each of the movable side panels being pivotally joined to the movable center panel and to the adjacent movable side panel.

4. The offset dish structure as set forth in claim 1, and further including:

a support that folds and unfolds with the panel assemblies between contracted and extended positions; and a transducer mounted on the support such that the transducer is positioned substantially at the focus of the offset surface of revolution when the dish structure is in the deployed configuration, thereby placing the transducer outside of the beam path of the dish structure.

* * * * *